United States Patent [19]

Kornaker

[11] Patent Number: 4,929,210

[45] Date of Patent: May 29, 1990

[54] CATHODE-RAY TUBE SUPPORTING RACK

[75] Inventor: Walter Kornaker, Ulm, Fed. Rep. of Germany

[73] Assignee: Nokia Graetz, Pforzheim, Fed. Rep. of Germany

[21] Appl. No.: 789,717

[22] Filed: Oct. 21, 1985

[30] Foreign Application Priority Data

Oct. 26, 1984 [DE] Fed. Rep. of Germany ..... 3439198

[51] Int. Cl.[5] ..... H01J 9/50

[52] U.S. Cl. ..... 445/73; 138/129; 138/131

[58] Field of Search ..... 445/70, 15, 73, 16; 138/122, 129, 131

[56] References Cited

U.S. PATENT DOCUMENTS

| | | | |
|---|---|---|---|
| 267,343 | 11/1882 | Harbison | 138/131 |
| 399,540 | 3/1889 | Lee | 138/129 |
| 2,986,169 | 5/1961 | McCormick | 138/131 |
| 3,712,699 | 1/1973 | Syster | 445/73 |
| 4,217,015 | 8/1980 | Matsumoto | 445/73 |
| 4,224,463 | 9/1980 | Koerber | 138/129 |

FOREIGN PATENT DOCUMENTS

| | | | |
|---|---|---|---|
| 0053044 | 3/1982 | Japan | 445/73 |

*Primary Examiner*—Kurt Rowan

*Attorney, Agent, or Firm*—Peter C. Van Der Sluys

[57] ABSTRACT

A rack for supporting a cathode-ray tube during sealing of the screen portion of the tube to the bulb cone portion of the tube is disclosed. The rack includes tubing mounted to the rack through which gas can be blown into the tube. An exit end section of the tubing is of flexible design and includes a helical spring and a plurality of resilient leaf spring tongues for aligning the tubing in the neck of the cathode-ray tube.

3 Claims, 1 Drawing Sheet

CATHODE-RAY TUBE SUPPORTING RACK

BACKGROUND OF THE INVENTION

The invention relates to a rack for supporting a cathode-ray tube during manufacture providing for attachment of the faceplate portion of the tube to the bulb portion of the tube.

The Japanese patent publication No. 53-123 654 discloses a method of sealing or fusing the faceplate to the cone of a color picture tube in which the tube is placed on a rack and is then moved on a conveyor through a continuous furnace. To the rack there is mounted a tubing having one end extending to the neck of the tube and through which a gas for removing organic substances which result from the tube being heated in the continuous furnace, can be blown into the tube.

The inlet end of the tubing is widened in a funnel-shaped manner and terminates below the rack, but above the belt conveyor on which the rack is placed. Cathode-ray tubes can be easily damaged if not placed vertically or if lifted in a non-vertical manner for the purpose of removing and inserting the tubing from the cathode-ray tube. It can be appreciated that, in connection with this conventional type of rack, the bottom of the tube below the rack must be capable of being lifted and lowered for insertion and removal of the gas supply tube. This has required that a special device must be provided for at both the beginning and the end of the continuous furnace. Further, when gas is blown into the tubing either in the proximity of or through the belt conveyor, great care has to be taken in order to prevent dirt particles which always exist in this area from being blown into the cathode-ray tube.

SUMMARY OF THE INVENTION

According to a preferred aspect of the invention, there is provided a rack for supporting a cathode-ray tube, which permits simple placement and removal of purge gas supply tubes.

According to a very important feature of the invention, there is provided a support rack having a gas supply tubing mounted with an inlet end positioned above the rack.

Another feature of the invention provides a flexible portion of the gas supply tube for insertion into the neck of the cathode-ray tube to include a helical spring.

According to another important aspect of the invention, there are provided leaf springs on the flexible end of the gas supply tube for guiding the tube in the neck of the cathode-ray tube.

BRIEF DESCRIPTION OF THE DRAWINGS

The invention will be better understood after a reading of the following Detailed Description Of The Preferred Embodiment in conjunction with the accompanying drawings, in which.

DETAILED DESCRIPTION OF THE PREFERRED EMBODIMENT

Figure 1:
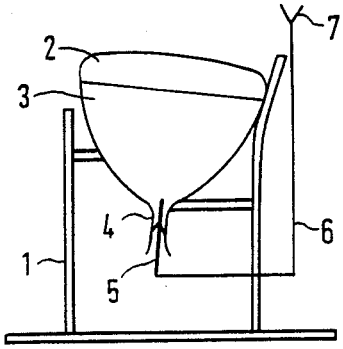
FIG. 1 shematically shows a rack in a sideview with a cathode-ray tube placed thereon.

FIG. 1 schematically shows a rack 1, a plurality of which in use are placed next to and behind each other on a belt conveyor of a continuous furnace. The sealing of a faceplate 2 to a bulb 3 of a cathode-ray tube with the aid of solder glass and a continuous furnace is well known, and is, therefore, not referred to in great detail herein.

Figure 2:
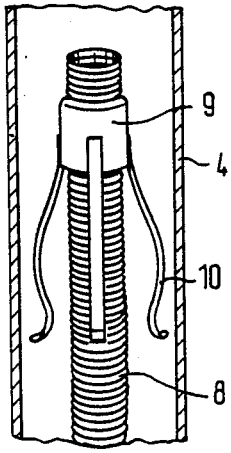
FIG. 2 perspectively shows the helical spring and leaf springs extending into the neck of the cathode-ray tube.

The cathode-ray tube is inserted into the rack 1 against limit stops, not shown, at a small angle relative to the vertical line of the rack, so that no displacement occurs between the faceplate 2 and the bulb 3 during movement of the assembly through the continuous furnace. As shown in FIG. 2, into the neck 4 of the cathode-ray tube there extends a section 5 of a tubing 6 whose inlet end 7 terminates above the top of the rack 1. The inlet is widened in a funnel-shaped manner in order that the gas to be blown in can be received therein in a simple manner from a supply tubing (not shown) disposed inside the continuous furnace.

FIG. 2 shows part of the neck 4 of the cathode-ray tube in a sectional view, with the section 5 of the tubing 6 being shown therein in a perspective representation. The section 5 is of flexible design and consists of a helical spring 8 whose windings are close to one another. The close spacing of the windings, on the one hand, permits a gas to be conducted through the helical spring 8 and, on the other hand, the cathode-ray tube can also be placed with its neck slantingly upon the helical spring or removed therefrom, without the neck 4 being damaged.

A flat ring 9 is displaced near the exit end of the helical spring 8 to which preferably at least three leaf spring tongues 10 are mounted. The spring tongues 10 improve the guidance of the helical spring 8 inside the neck 4. For best operation, the helical spring 8 preferably includes the leaf spring tongues 10, however, it may also be used without them if desired.

The helical spring 8 and, if used, the leaf spring tongues 10 are made from a material which is resistant to the heat inside the continuous furnace. The helical spring 8, for example, is mounted to the tubing 6 with the aid of a sleeve nut (not shown) and, therefore, is easy to replace if necessary.

Having described a preferred embodiment of the invention, those skilled in the art can devise other embodiments and modifications. Therefore, those other embodiments and modifications are to be considered to be within the scope of the appened claims.

I claim:

1. A rack for supporting a cathode-ray tube during attachment of a faceplate and a bulb together with a glass solder while being moved through a continuous furnace comprising, purge gas tubing mounted to said rack including an exit portion extending into a neck portion of the bulb, the exit portion of the tubing which extends into the neck being flexible, said tubing including a free end positioned above the rack defining an inlet, said free end inlet configured to receive said purge gas blown thereinto.

2. The rack as claimed in claim 1, wherein the flexible exit portion includes a helical spring having windings lying in close proximity to each other.

3. The rack as claimed in claim 2, further comprising a plurality of leaf spring tongues on the helical spring.

* * * * *